United States Patent [19]

Weyant, Jr.

[11] 4,431,423

[45] Feb. 14, 1984

[54] CELL WASHING APPARATUS HAVING RADIALLY INWARDLY DIRECTED RETAINING ARMS

[75] Inventor: Oakley L. Weyant, Jr., Southbury, Conn.

[73] Assignee: E. I. Du Pont de Nemours & Company, Wilmington, Del.

[21] Appl. No.: 356,714

[22] Filed: Mar. 10, 1982

[51] Int. Cl.[3] ..... B04B 9/12

[52] U.S. Cl. ..... 494/20

[58] Field of Search ..... 494/20, 16, 17, 19, 494/21; 366/235, 218, 198

[56] References Cited

U.S. PATENT DOCUMENTS

| | | | |
|---|---|---|---|
| 2,202,157 | 5/1940 | Levy | 233/26 |
| 3,151,073 | 9/1964 | Anthon | 233/4 |
| 3,850,638 | 11/1974 | Boeckeler | 233/25 |
| 3,877,634 | 4/1975 | Rohde et al. | 233/14 R |
| 3,951,334 | 4/1976 | Fleming et al. | 233/26 |
| 3,981,438 | 9/1976 | Weyant | 233/26 |
| 4,010,892 | 8/1977 | Revillet et al. | 233/23 A |
| 4,093,118 | 6/1978 | Sinn et al. | 233/26 |
| 4,141,489 | 2/1979 | Wright | 233/26 |
| 4,221,324 | 9/1980 | Frey | 233/26 |
| 4,236,666 | 12/1980 | Aeschlimann et al. | 233/26 |

*Primary Examiner*—Robert W. Jenkins

[57] ABSTRACT

A cell washing apparatus having a pivotally movable sample tube holder provided with a radially inwardly directed arm having a grasping hook thereon. The hook engages a retaining surface disposed radially inwardly of the pivot point of the holder to restrain radial outward movement of the sample tube holder.

8 Claims, 2 Drawing Figures

CELL WASHING APPARATUS HAVING RADIALLY INWARDLY DIRECTED RETAINING ARMS

BACKGROUND OF THE INVENTION

This invention relates to a cell washing apparatus and, in particular, to a cell washing apparatus wherein the sample tube holders are provided with radially inwardly directed retaining arms.

A cell washing apparatus is a device adapted to wash a suspension of particles, such as blood cells, with a washing solution. A cell washing apparatus typically includes a rotor having a central shaft or spindle through which the axis of rotation extends. The spindle has a holding plate attached thereon. To the holding plate is pivotally attached an array of sample tube holders. Each of the sample tube holders receives a sample tube carrying a sample which includes the particles to be washed. A hemispherical bowl having an annular retaining lip surrounds the lower end of the rotating spindle.

During the cell packing cycle, as the rotor is rotated, the sample holders pivot radially outwardly under the influence of centrifugal force such that the lower end of each of the sample tubes is inclined in a radially outward direction i.e., the axis of each of the tubes defines a positive angle with respect to the axis of the spindle. The magnitude of the angle defined between the axis of the sample tubes with respect to the axis of rotation of the rotor is limited by the aoutment of the lower end of the sample tube holders against the lip on the bowl. While the sample tubes are being rotated a suitable cell washing solution is pumped into the open top of each sample tube. The sample cells move through the washing solution under the influence of centrifugal force and become packed at the bottom of the sample tube.

After the packing cycle is completed the rotor is stopped and the axes of the sample tubes assume a negative angle orientation wherein the lower ends of the sample tubes lie closer to the axis of rotation than do the upper ends. While in this orientation a retaining ring is brought into engagement with the lower end of each of the sample tube holders to hold the lower ends of the tubes in the radially inwardly orientation. The rotor is again rotated and the washing solution is purged from the tubes. The packing and purge cycle are repeated as often as desired.

It has been found that after repeated use the bowl has a tendency to exhibit fatigue cracks. This cracking is believed to be caused by the washing solution settling on the bowl as the solution is purged from the sample tubes during the purge cycle. Fatigue cracking of the bowl is believed to be disadvantageous in that it weakens the bowl and increases the possibility of rotor failure.

It is therefore believed advantageous to provide a cell washing apparatus wherein the bowl may be eliminated but the restraining function performed by the lip on the bowl may be retained.

SUMMARY OF THE INVENTION

This invention relates to a cell washing apparatus wherein each of the sample tube holders is provided with a radially inwardly extending arm having a grasping hook at the radially inward end thereof. While in the packing cycle the sample tube holders are restrained and the positive angle defined between the axis of the sample tube and the axis of the spindle is limited by the engagement of the grasping hook with a retaining surface defined on the rotor at a point disposed radially inwardly of the pivot point of the tube holders.

In one embodiment of the invention the retaining surface is provided on a disk mounted on the spindle. The engagement of the grasping hook with the retaining lip on the disk prevents radial outward movement of the sample tube holders beyond a predetermined positive angle. In an alternate embodiment of the invention, the arm extends through a slot defined in the holding plate. As the rotor rotates, the grasping hook engages the retaining surface defined by a portion of upper surface of the holding plate to prevent radial outward movement of the sample tube holders beyond a predetermined positive angle. Each of the sample tube holders is counterbalanced to compensate for the mass of the arms to permit the sample tubes to occupy the negative angle orientation so that a ring may engage the tubes and the purge cycle effected.

BRIEF DESCRIPTION OF THE DRAWINGS

The invention will be more fully understood from the following detailed description thereof taken in connection with the accompanying drawings which forms a part of this application and in which.

DETAILED DESCRIPTION OF THE INVENTION

Figure 1:
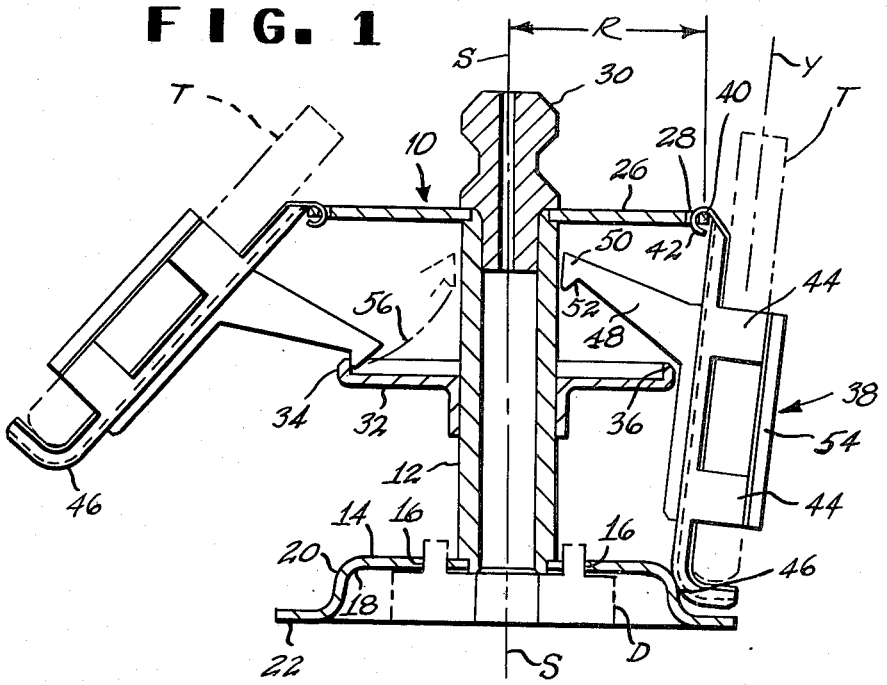
FIG. 1 is a side elevational view partially in section of a cell washing apparatus in accordance with one embodiment of the present invention.

With reference to the Figures, a rotor for a cell washing apparatus is generally indicated by reference character 10. The rotor 10 includes a hollow central spindle 12 through which the axis of rotation S extends. The spindle 12 is notched at its upper and lower ends. A base plate 14 is mounted against the shoulder defined by the notch at the lower end of the spindle 12 by swagging or other suitable form of interconnection. The base plate has an annular array of openings 16 which surrounds the spindle 12. The openings 16 receive pins mounted on a driving member D so that rotational energy may be applied to the rotor 10. The base plate 14 is bent, as at 18, to define an annular abutment surface 20 generally concentric with the axis S of the spindle. The lower surface 22 of the outermost edge of the base plate lie in a common plane.

A holding plate 26 is mounted against the shoulder defined by the notch at the upper end of the spindle 12. Any suitable means of attachment may be utilized, although swagging is preferred. The top plate 26 is provided with an array of slots 28 each disposed at a predetermined radial distance R from the axis S near the periphery of the rotor 10. The surface of the top plate 26 lies parallel to the plane of lower surface 22 of the outer edge of the base plate 14. The surface of the plate 26 is preferably perpendicular to the axis S of the spindle. The upper end of the hollow spindle 12 is provided with a plug 30 which engages a distributor (not shown).

Figure 2:
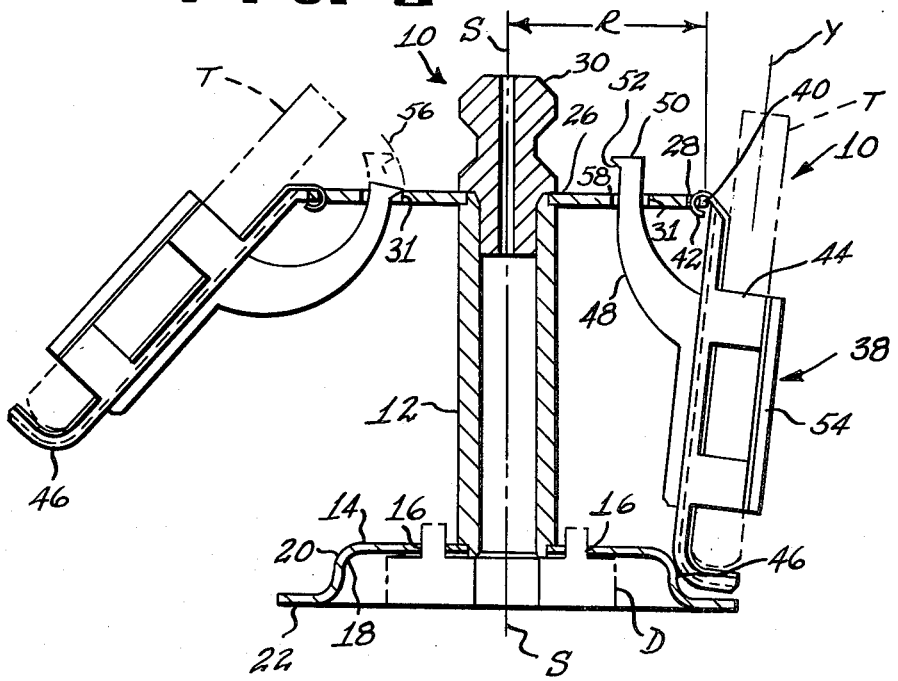
FIG. 2 is a view similar to FIG. 1 showing an alternate embodiment of the invention.

In the embodiment of the invention shown in FIG. 2, the holding plate 26 is provided with an array of slots 31 disposed at points radially inwardly from the slots 28 on the periphery of the rotor. The slots 31 correspond in number to the slots 28 and are provided for a purpose discussed more fully herein.

In the embodiment of the invention shown in FIG. 1, a retaining disk 32 having an annular lip 34 is disposed substantially midway along the height of the spindle 12. The disk 32 may be attached to the spindle 12 by welding or any other suitable form of attachment. The disk 32 is parallel to the holding plate 26. The lip 34 is provided with a cylindrical back surface 36 for a purpose to be made clear herein. The back surface 36 lies radially inwardly of the slots 28 on the periphery of the rotor.

A plurality of sample tube holders 38 is pivotally mounted to the top plate 26 for swinging movement toward and away from the spindle 12. The number of sample tube holders 38 corresponds to the number of the slots 28. Each sample tube holder 38 is secured to the holding plate 26 by a flap 40 which is insertable through one of the slots 28 in the top plate 26 and wrapped, as at 42, to thereby hinge the tube holder 38 to the holding plate 26. Each sample tube holder 38 is provided with cradles 44 which are sized to receive and support a sample tube T (shown in dot-dash lines in the Figures) carrying particles to be washed. The lower end of the sample tube holder 38 is curved, as at 46, to define a support surface for the lower end of the sample tube T. Extending radially inwardly toward the central axis of the spindle 12 from each of the sample tube holders 38 is an arm member 48. Each arm member 48 terminates in a grasping hook 50. Each hook 50 has a grasping surface 52 thereon. Mounted on the exterior of each of the cradles 44 of the sample tube holders is a counterbalancing weight 54.

In the embodiment of the invention shown in FIG. 1, the arms 48 lie in their entirety below the surface of the holding plate 26. However, as seen in the alternate embodiment of the invention shown in FIG. 2, each arm 48 projects inwardly through the slot 31 corresponding to the associated sample tube holder 38 such that the hook 50 lies above the holding plate 26.

The sample tube holders 38 are each provided with a sample tube T carrying cells to be washed. Before the rotor 10 is rotated the axis Y of each of the sample tubes defines a slightly negative angle with respect to the central axis of the spindle 12. That is, the lower end of each tube T lies radially closer to the axis S of the rotor than does the top of the tube. The negative angle of repose is due to the effect of the counterbalancing weight 54. In this rest position (shown on the right side of each of the Figures) the lower end 46 of the sample tube holder 38 abuts at its radial inner surface against the surface 20 on the base plate 14.

In operation, as the spindle 12 is rotated about its axis S the sample tube holders 38 and the tubes T carried therein swing radially outwardly under the influence of centrifugal force. The swinging motion of the sample tube holders 38 moves the grasping hooks 50 disposed on the inward end of the radial arms 48 along an arc 56 bringing the grasping surfaces 52 carried by the hooks 50 into engagement a retaining surface defined on the rotor 10 at a point radially inwardly of the points at which the tube holders are pivotally mounted. In the embodiment of the invention shown in FIG. 1, the retaining surface is defined by with the back surface 36 of the lip 34 provided on the rim of the retaining disk 32. In the embodiment of the invention shown in FIG. 2, the retaining surface is defined by that portion 58 of the upper surface of the holding plate 26 radially inwardly adjacent to the slots 31 therein. In either case, the overlapping engagement of the grasping hook 50 with the retaining surface prevents further radial outward movement of the sample tube holders 38. This position is illustrated on the left side of each of the Figures. The overlap between the hook 50 and the retaining surface is sufficient to restrain and limit the magnitude of the positive angle defined between the axis Y of the sample tubes T and the axis S of the rotor 10.

After the packing cycle is completed the rotor is slowed to a stop and the sample tube holders 38 and the tubes T carried thereby assume the rest position and again define the negative angle with respect to the axis of the spindle 12. A retaining ring (not shown) restrains the lower ends of the sample tubes during the purge cycle.

From the foregoing it may appreciate that in accordance with this invention the restraining and limiting action brought about by the bowl of prior art cell washing apparatus is retained even though the bowl itself is eliminated. Those skilled in the art, having benefit of the teachings hereinabove set forth hereinabove may effect numerous modifications thereto. However, such modifications are to be construed as lying within the scope of the instant invention as defined by the appended claims.

What is claimed is:

1. A rotor for a cell washing apparatus comprising:
   a spindle having an axis of rotation extending therethrough;
   a holding plate attached to the spindle;
   a sample tube holder pivotally mounted to the holding plate at a pivot point disposed a predetermined radial distance from the axis, the tube being pivotally movable from a first, rest, position to a second, extended, position;
   a radially inwardly depending arm disposed on the sample tube holder, the arm terminating in a grasping hook; and
   a retaining disk mounted to the spindle, the retaining disk having a retaining surface thereon, the retaining surface being disposed on the rotor at a position radially inwardly of the pivot point, the grasping hook being arranged to engage the retaining surface when the sample tube holder pivots to the second, extended, position.

2. The rotor of claim 1 further comprising a counterbalance mounted to the sample tube holder and adapted to incline the sample tube holder at a negative angle while the sample tube holder is in the rest position.

3. The rotor of claim 2 wherein the retaining surface is disposed below the pivot point of the sample tube holder.

4. The rotor of claim 1 wherein the retaining surface is disposed below the pivot point of the sample tube holder.

5. A rotor for a cell washing apparatus comprising:
   a spindle having an axis of rotation extending therethrough;
   a holding plate attached to the spindle, a portion of the upper surface of the holding plate defining a retaining surface thereon, the holding plate having a slot therein;
   a sample tube holder pivotally mounted to the holding plate at a pivot point disposed a predetermined radial distance from the axis and at a position radially outwardly of the retaining surface, the tube holder being pivotally movable from a first, rest, position to a second, extended, position;

a radially inwardly depending arm disposed on the sample tube holder, the arm terminating in a grasping hook, the arm extending through the slot such that the grasping hook is disposed above the upper surface of the holding plate when the sample tube holder is in the first, rest, position, the grasping hook being arranged to engage the retaining surface when the sample tube holder pivots to the second, extended, position.

6. The rotor of claim 5 further comprising a counterbalance mounted to the sample tube holder and adapted to incline the sample tube holder at a negative angle while the sample tube holder is in the rest position.

7. The rotor of claim 6 wherein the retaining surface is disposed at a point substantially coplanar with the pivot point of the sample tube holder.

8. The rotor of claim 5 wherein the retaining surface is disposed at a point substantially coplanar with the pivot point of the sample tube holder.

* * * * *